United States Patent [19]

Rose

[11] Patent Number: 4,580,488

[45] Date of Patent: Apr. 8, 1986

[54] WEATHER CAPS FOR EXHAUST PIPES

[75] Inventor: George E. Rose, Ferny Creek, Australia

[73] Assignee: Olibin Limited, Hong Kong, Hong Kong

[21] Appl. No.: 702,616

[22] Filed: Feb. 19, 1985

[51] Int. Cl.[4] ..... F23L 17/02

[52] U.S. Cl. ..... 98/59

[58] Field of Search ..... 16/378; 49/387; 98/59, 98/122

[56] References Cited

U.S. PATENT DOCUMENTS

| | | | |
|---|---|---|---|
| 2,983,216 | 5/1961 | Stade et al. | 98/59 |
| 4,255,928 | 3/1981 | Jones et al. | 98/59 |
| 4,495,859 | 1/1985 | Janke et al. | 98/59 |

*Primary Examiner*—Harold Joyce

*Attorney, Agent, or Firm*—Bernard, Rothwell & Brown

[57] ABSTRACT

A weather cap for an exhaust pipe includes a mounting collar adapted to surround the exhaust pipe and including supporting arms extending therefrom. A resilient bumper is supported on a clamping bolt extending through the supporting arms. The resilient bumper includes a portion extending above the collar so as to be engageable by the weather cap or its counterbalance arm in the closed position of the cap. The bumper further includes a dependent portion engageable by the counterbalance arm in the open position. The resilient bumper minimizes noise in both the open and closed positions of the cap.

7 Claims, 3 Drawing Figures

WEATHER CAPS FOR EXHAUST PIPES

BACKGROUND OF THE INVENTION

This invention relates to improvements in weather caps for exhaust pipes.

Weather caps for exhaust pipes which are pivotally attached to the top of vertical exhaust pipes to prevent entry of rain, dust and the like when the engine is not operating are widely used and are disclosed in more detail for example in U.S. Pat. Nos. 2,983,216 Stade et al and 4,059,045 McClain et al.

One problem with weather caps of the above type is that they tend to create undesirable noise caused by metal to metal contact as the cover is provided by the exhaust of the engine. One attempt to solve such problems is disclosed in U.S. Pat. No. 4,255,928 Jones et al.

While the solutions posed by the above United States patent successfully reduce the noise created by oscillation of the weather cap under the influence of the exhaust, they require modification of the clamping assembly of the cover and of the balance arm and, at least in the case of the second embodiment, the bumper member has been found to be prone to fracture under the stresses applied to the bumper by the oscillatory weather cap.

It is the object of the present invention to provide a means for reducing noise in weather caps for exhaust pipes which requires less modification to the supporting structure for the cap and which is less likely to fracture in use.

According to the invention there is provided a weather cap comprising a mounting collar adapted to surround the exhaust pipe to be protected, a clamping bolt for bringing the ends of the collar together to clamp the collar in position around the exhaust pipe, mounting arms extending from the ends of the collar and between which a bearing supporting a counterbalance arm and cap is secured, characterized by resilient bumper means supported by the clamping bolt and including a portion projecting above the uppermost edge of the collar so as to be engaged by the counterbalance arm or cap when in the rest position and a portion projecting below the clamping bolt so as to be engaged by the counterbalance arm when in the fully open position, said bumper having means engaging one arm of said mounting collar to prevent rotation of said bumper on said bolt.

It will be appreciated from the above that by using the clamping bolt to support the bumper, the only modification to the weather cap is the addition of the bumper. Thus, contrary to the embodiments disclosed in U.S. Pat. No. 4,255,928, each of which requires substantial modification to the clamping collar of the cap structure, the silencing effect of the bumper is achieved at a minimal additional cost. Similarly, since the bumper is evenly supported throughout its length by the clamping bolt, specific regions of stress, such as occur with the embodiment of FIG. 8 of the above U.S. Patent, are less likely to occur.

The invention also provides a resilient bumper for an exhaust weather cap comprising an elongate head portion and a downwardly extending portion positioned centrally of said head portion, a bore in said downwardly extending portion for receiving a weather cap clamping bolt, said head portion being dimensioned to extend above the uppermost edges of a clamping collar for said weather cap so as to engage at least one arm of said collar to prevent rotation of said bumper, said downwardly extending portion being dimensioned to extend below said clamping collar.

BRIEF DESCRIPTION OF THE DRAWINGS

One preferred embodiment of the invention will now be described with reference to the accompanying drawings in which.

Figure 3:
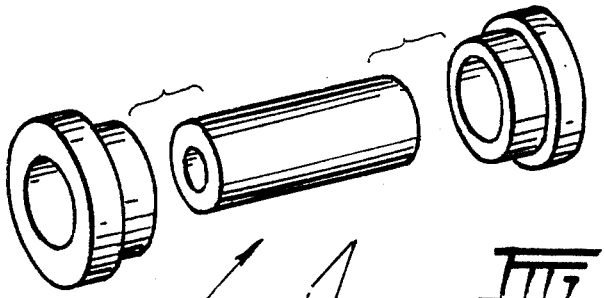
FIG. 3 shows an exploded view of a preferred bearing arrangement.
Figure 1:
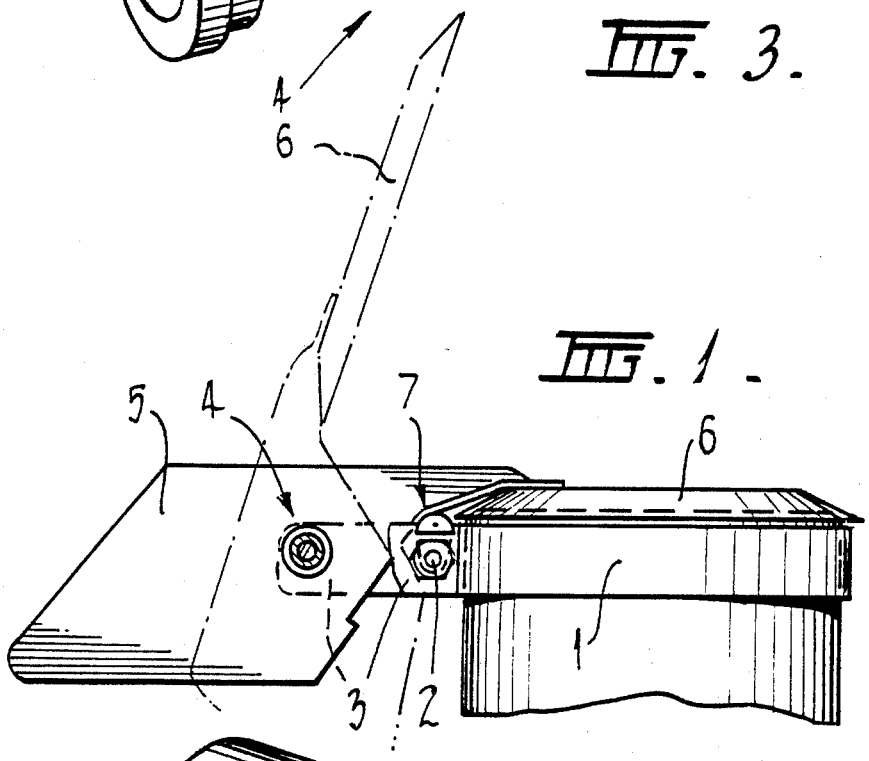
FIG. 1 is a side elevation of a cap assembly incorporating the resilient bumper embodying the invention.

Referring firstly to FIG. 1 of the drawings, the weather cap will be seen to comprise a mounting collar 1, comprising a strap of plated mild steel which is shaped to encircle the exhaust pipe to which the cap is secured by means of a clamping bolt 2 passing through holes formed in the ends of the collar 1. Supporting arms 3 extend rearwardly from the ends of the collar 1 and support between them a bearing assembly 4 by means of which a counterbalance arm 5 and attached cap 6 are mounted for pivotal movement on the mounting collar 1. In the present embodiment, the bearing assembly 4 (FIG. 3) comprises a pair of outer bushes having reduced diameter portions which are a force fit in bearing positions in the counter balance arm 5 and receiving a central bush supported by the bolt 2 engaging the supporting arms 3. In this arrangement, the outer bushes and the central bush are formed from suitable heat resistant plastics material such as polytetrafluoroethylene or a polyamide (nylon). The bushes are shown in FIG. 3 of the drawings.

Figure 2:
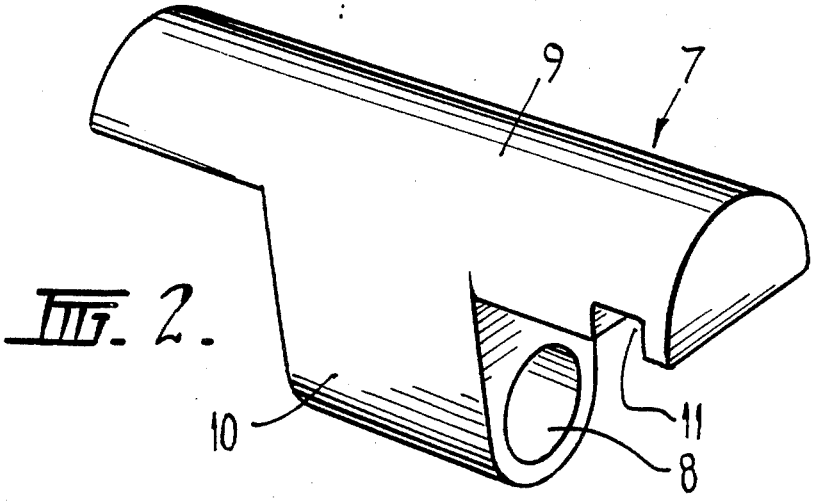
FIG. 2 shows an isometric view of the bumper shown in FIG. 1.

A resilient bumper means 7, of suitable heat resistant plastics material, such as polytetrafluoroethylene, is supported by the clamping bolt 2 and is located between the ends of the mounting collar 1 in the manner shown in FIG. 1 of the drawings. As will be seen from FIG. 2 of the drawings, the bumper 7 is generally T-shaped in side elevation, having a bore 8 formed in the leg of the T for receiving the clamping bolt 2 and having a head portion 9 which in use extends above the upper edge of the mounting collar 1 so as to be engaged by a portion of the counterbalance arm 5 in the closed position of the cap 6, whereby the cap 6 is supported slightly above the top of the exhaust pipe. The arms of the T rest on the upper edges of the ends of the mounting collar to prevent rotation of the bumper on the bolt 2. Similarly, the bumper 7 has a portion 10 which extends below the clamping bolt 2 and which is engaged by a lower portion of the counterbalance arm 5 in the fully open position of the cap as shown in broken outline in FIG. 1 of the drawings.

To prevent lateral displacement of the bumper 7 on the clamping bolt 2, whilst still allowing for the ends of the mounting collar to be drawn together during the clamping action of the clamping bolt 2, a notch 11 is formed in the underside of one of the arms of the T, which notch 11 engages the edge of one of the ends of the mounting collar 1 in the manner shown in FIG. 1 of the drawings. The other arm of the T in use rests on the upper edge of the other end of the mounting collar 1 so that the bumper 7 is appropriately supported.

Although the above described means for preventing rotation of the bumper 7 is preferred for its simplicity and low manufacturing cost, it should be appreciated that other methods of preventing rotation and lateral displacement of the bumper 7 may be devised by persons skilled in the art. For example, if the width of the leg of the T is made slightly narrower than the minimum distance between the ends of the mounting collar in the fully clamped position, a similar result would be achieved. However, such an arrangement has the disadvantage of requiring a specific bumper for each size of mounting collar.

What we claim is:

1. A weather cap comprising a mounting collar adapted to surround the exhaust pipe to be protected, a clamping bolt for bringing the ends of the collar together to clamp the collar in position around the exhaust pipe, mounting arms extending from the ends of the collar and between which a bearing supporting a counterbalance arm and cap is secured, characterized by resilient bumper means supported by the clamping bolt and including a portion projecting above the uppermost edge of the collar so as to be engaged by the counterbalance arm or cap when the rest position and a portion projecting below the clamping bolt so as to be engaged by the counterbalance arm when in the fully open position, said bumper having means engaging one arm of said mounting collar to prevent rotation of said bumper on said bolt.

2. The cap of claim 1, wherein said bumper means comprises a head portion extending transversely of said ends of said collar and a downwardly extending portion extending substantially centrally from said head portion, said downwardly extending portion being formed with a bore receiving said clamping bolt, said head portion being dimensioned to engage at least one of said ends of said collar to prevent rotation of said bumper on said bolt.

3. The cap of claim 2, wherein both of said ends are engaged by said head portion.

4. The cap of claim 2, wherein said head portion is formed with a notch which engages one of said ends of said collar to prevent lateral displacement of said bumper relative to said mounting collar.

5. The cap of claim 3, wherein said head portion is formed with a notch which engages one of said ends of said collar to prevent lateral displacement of said bumper relative to said mounting collar.

6. A resilient bumper for an exhaust weather cap comprising an elongate head portion and a downwardly extending portion positioned centrally of said head portion, a bore in said downwardly extending portion for receiving a weather cap clamping bolt, said head portion being dimensioned to extend above the uppermost edges of a mounting collar for said weather cap so as to engage at least one arm of said collar to prevent rotation of said bumper, said downwardly extending portion being dimensioned to extend below said mounting collar.

7. The resilient bumper of claim 6, wherein said head portion is formed with a notch adapted to engage one of the ends of said mounting collar to prevent lateral displacement of said bumper relative to said mounting collar.

* * * * *